US008662098B2

(12) United States Patent
Foster

(10) Patent No.: US 8,662,098 B2
(45) Date of Patent: Mar. 4, 2014

(54) SYSTEM AND METHOD OF WINTERIZING A PLUMBING SYSTEM

(76) Inventor: David S Foster, Adams, WI (US)

( * ) Notice: Subject to any disclaimer, the term of this patent is extended or adjusted under 35 U.S.C. 154(b) by 349 days.

(21) Appl. No.: 12/806,040

(22) Filed: Aug. 4, 2010

(65) Prior Publication Data

US 2011/0290335 A1 Dec. 1, 2011

Related U.S. Application Data

(60) Provisional application No. 61/396,703, filed on Jun. 1, 2010.

(51) Int. Cl.
*B67D 7/72* (2010.01)

(52) U.S. Cl.
USPC ..... 137/209; 137/59; 138/35

(58) Field of Classification Search
USPC ..... 137/59, 209, 301; 138/34, 35
See application file for complete search history.

(56) References Cited

U.S. PATENT DOCUMENTS

| | | | | | |
|---|---|---|---|---|---|
| 3,384,123 | A | * | 5/1968 | Saddison | 138/34 |
| 4,124,039 | A | * | 11/1978 | St. Laurent | 138/35 |
| 4,286,617 | A | | 9/1981 | Bedient | |
| 4,298,021 | A | | 11/1981 | Bozeman | |
| 4,531,538 | A | | 7/1985 | Sandt et al. | |
| 5,488,968 | A | | 2/1996 | Price et al. | |
| 5,676,182 | A | | 10/1997 | McMullen, Jr. et al. | |
| 5,715,869 | A | * | 2/1998 | Patterson | 138/35 |
| 6,237,620 | B1 | | 5/2001 | Ferguson | |

* cited by examiner

*Primary Examiner* — John K Fristoe, Jr.
*Assistant Examiner* — Reinaldo Sanchez-Medina
(74) *Attorney, Agent, or Firm* — Ryan Kromholz & Manion, S.C.

(57) ABSTRACT

A method and apparatus for winterizing a plumbing system, the apparatus including a fluid reservoir, an air manifold, and a house inlet line. The house inlet line is coupled to the fluid outlet of the reservoir and the outlet of the air supply. The apparatus includes an air flow valve, a fluid valve and a reservoir air inlet valve. The house inlet line is adapted to provide antifreeze, air, or both to the plumbing system depending on the arrangement of the valves. The method includes blowing the fluid from the hot water lines, introducing antifreeze to the hot water lines, pushing antifreeze through the hot water lines, blowing the fluid from the cold water lines, introducing antifreeze to the cold water lines, and pushing antifreeze through the cold water lines.

13 Claims, 2 Drawing Sheets

SYSTEM AND METHOD OF WINTERIZING A PLUMBING SYSTEM

RELATED APPLICATIONS

This application claims priority to co-pending U.S. Provisional Patent Application Ser. No. 61/396,703 for System and Method of Winterizing a Plumbing System, filed 1 Jun. 2010.

BACKGROUND OF THE INVENTION

Many dwellings (such as cottages, lodges, trailers, mobile homes, RV's boats, and yachts) are used on a seasonal basis. Such dwellings and structures are typically used during months of the year in which the temperature is moderate. In climates that experience winter temperatures below freezing, such dwellings need to be prepared for winter prior to the occurrence of freezing temperatures.

Such dwellings and vehicles are normally connected to a water system. For instance, a cottage may have a water inlet pipe located within a nearby lake or may be connected to a well system for supply of water to the cottage. Trailers may obtain water from similar sources, or may obtain water from a centrally located supply within a trailer park or campground in which the trailer is located. The water is used within the dwelling in toilets, for washing of dishes, showers or for other purposes. This may include uses outside the dwelling, for instance watering of a garden, washing of objects or recreation. Thus, a typical dwelling may have a water pump supplying a water tank from which water is fed, for instance, to one or more of taps within the dwelling, as well as to a toilet, a shower and a hot water tank.

In the winter, water within piping systems, toilets and other related systems, e.g. any septic bed pumping tanks, will freeze. Thus, at the end of the seasonal occupation of the seasonal dwelling, it is necessary to remove water from all piping systems, including tanks, within the dwelling to prevent freezing of the water within the system. If water is allowed to remain within the piping systems, then upon freezing the piping systems will often crack, break or be otherwise damaged and require significant repair in the following spring.

Thus, persons who own cottages, trailers or other seasonal dwellings have a need to winterize the dwelling at the end of the season. This usually entails draining of pipes to the extent that this is possible, pouring winterizing solutions e.g. antifreeze, down toilets, showers, sinks and the like, bailing out of toilets and other vessels of that kind and feeding winterizing solutions into pumps. The latter is often done using funnels and pouring the liquid into a suitable inlet within the pump.

Alternatively, the water pipe is disconnected from the source of water. Air is blown down the water line by one person, which normally requires the assistance of a second person to open each and every valve, making sure no water is retained in the piping system. Then a garden hose is filled with antifreeze, using a funnel, with the second person opening the valves again. This procedure must be repeated several times to effect winterizing. The winterizing process is tedious, slow and requires more than one person.

Winterizing is often conducted under adverse conditions in the fall, e.g. in near-freezing temperatures and often cold, wet and windy weather. It is an onerous task that must be completed with care to prevent damage to the piping systems and other water-containing vessels in or associated with the seasonal dwelling.

In some instances, particularly in trailer parks or campgrounds, it is possible to arrange for persons to winterize a trailer, for a fee. While the fee may not be particularly excessive in any one year, over a period of years the accumulated costs can be substantial. Thus, there has been a need by owners of cottages, trailers or other seasonal dwellings for a means of winterizing the water piping systems within the dwelling in a quick and efficient manner.

SUMMARY OF THE INVENTION

The invention provides a system for winterizing a plumbing system. One aspect of the invention provides a system including an air source having an air source outlet, a fluid reservoir having an air inlet and an outlet where the air inlet is in selective fluid communication with the air source outlet and a house inlet line having a first end and a second end, where the first end of the house inlet line is in selective fluid communication with both the fluid reservoir outlet and the air source outlet.

An additional aspect of the invention is a system including an air manifold having a manifold inlet, a first manifold outlet and a second manifold outlet, where the manifold inlet is in fluid communication with the air source outlet, the first manifold outlet is in selective fluid communication with the fluid reservoir air inlet and the second manifold outlet is in selective fluid communication with the house inlet line second end.

An additional aspect of the invention is a system including a first valve between the first manifold outlet and the fluid reservoir air inlet, a second valve between the second manifold outlet and the house inlet line second end, and a third valve between the fluid reservoir outlet and the house inlet line second end.

An additional aspect of the invention is a system where the manifold is a three-way valve.

An additional aspect of the invention is a system including a fluid inlet.

An additional aspect of the invention is a system where the fluid inlet includes a cap.

An additional aspect of the invention is a system including a pressure gauge in fluid communication with the fluid reservoir air inlet.

An additional aspect of the invention is a system where the air source is an air compressor.

An additional aspect of the invention is a system where the second end of the house inlet line includes an adaptor sized and configured for connection to a faucet.

An additional aspect of the invention is a system where each of the first valve, the second valve, and the third valve are manually operated valves.

An additional aspect of the invention is a method for winterizing a plumbing system including the steps of providing a winterizing system. The winterizing system includes an air source having an air source outlet, a fluid reservoir having a air inlet and an outlet, the air inlet being in selective fluid communication with the air source outlet, a house inlet line having a first end and a second end, wherein the first end of the house inlet line is in selective fluid communication with both the fluid reservoir outlet and the air source outlet. The method also includes the steps of disconnecting the water supply from the plumbing system, coupling the second end of the house inlet line to the plumbing system, placing a predetermined amount of antifreeze in the fluid reservoir, draining the water from the plumbing system, blowing any remaining water out of the plumbing system and introducing a small amount of antifreeze into the plumbing system.

An additional aspect of the invention is a method for winterizing a plumbing system including the steps of providing a winterizing system. The winterizing system includes an air source having an air source outlet, a fluid reservoir having a air inlet and an outlet, the air inlet being in selective fluid communication with the air source outlet, an air manifold having a manifold inlet, a first manifold outlet and a second manifold outlet, wherein the manifold inlet is in fluid communication with the air source outlet, the first manifold outlet is in selective fluid communication with the fluid reservoir air inlet and the second manifold outlet is in selective fluid communication with the house inlet line second end, a first valve between the first manifold outlet and the fluid reservoir air inlet, a second valve between the second manifold outlet and the house inlet line second end, a third valve between the fluid reservoir outlet and the house inlet line second end, a house inlet line having a first end and a second end, wherein the first end of the house inlet line is in selective fluid communication with both the fluid reservoir outlet and the air source outlet. The method further includes the steps of disconnecting the water supply from the plumbing system, coupling the second end of the house inlet line to the plumbing system, placing a predetermined amount of antifreeze in the fluid reservoir, draining the water from the plumbing system, blowing any remaining water out of the plumbing system, introducing a small amount of antifreeze into the plumbing system.

An additional aspect of the invention is a method where the blowing step includes opening the second valve until no more water exits the plumbing system and then closing the second valve.

An additional aspect of the invention is a method where the introducing step includes pressurizing the fluid reservoir.

An additional aspect of the invention is a method where the fluid reservoir is pressurize by opening the first valve while the third valve is closed.

An additional aspect of the invention is a method where the introducing step includes opening the third valve for a predetermined amount of time and then closing the third valve.

An additional aspect of the invention is a method where the introducing step includes opening the second valve until antifreeze begins exiting the plumbing system and then closing the second valve.

An additional aspect of the invention is a method where the plumbing system includes a first faucet and a second faucet and the second end of the house inlet line is coupled to the first sink faucet.

An additional aspect of the invention is a method where step includes opening the second valve until antifreeze begins exiting the plumbing system through the second faucet and then closing the second valve.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
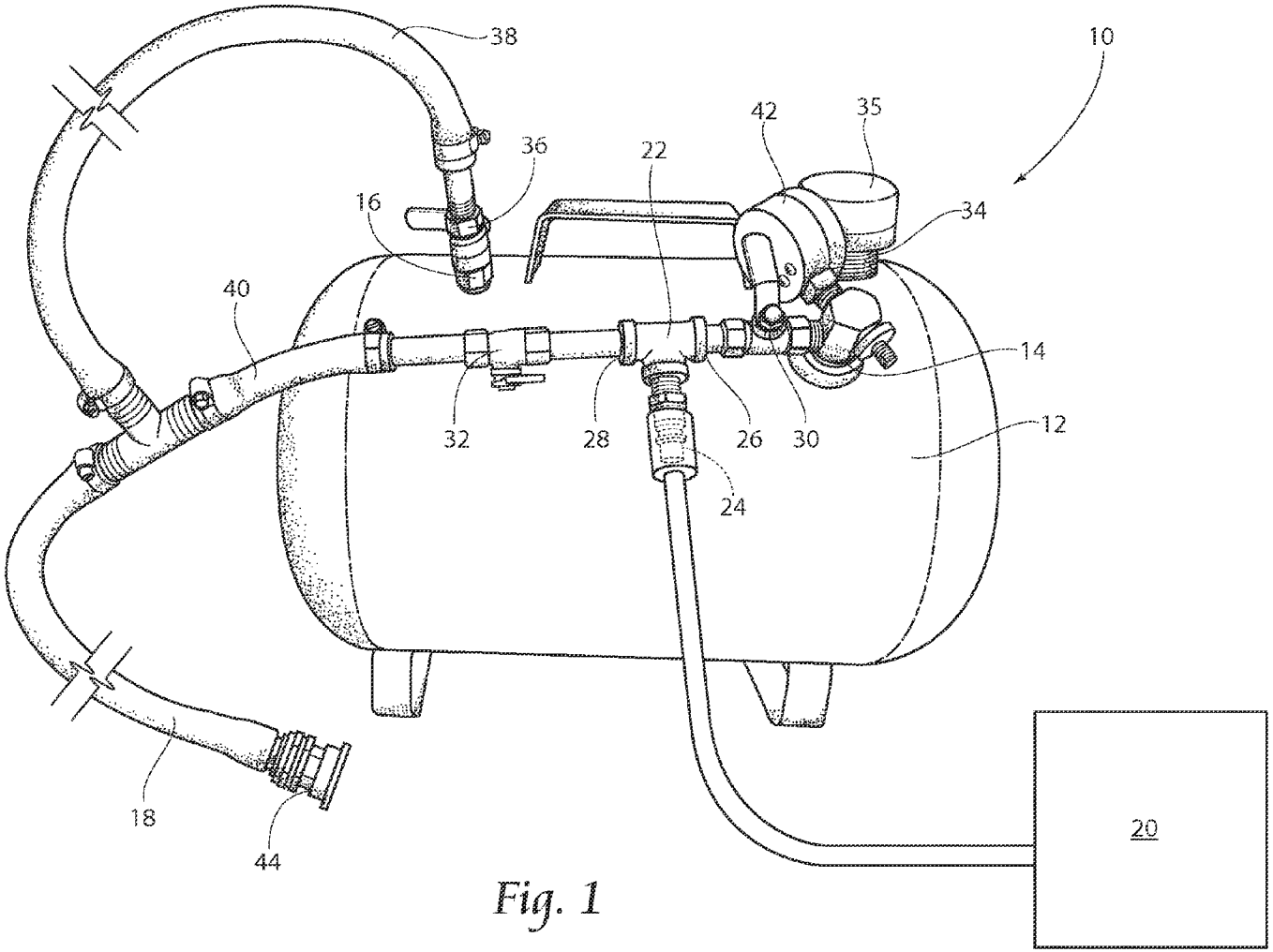
FIG. 1 is a front view of an embodiment of an apparatus according to the present invention.

An embodiment of an apparatus 10 according to the invention is shown in FIG. 1. The apparatus 10 preferably includes a fluid reservoir 12 having an air inlet 14 and an outlet 16. The outlet 16 is preferably coupled to the house inlet line 18. The air inlet 14 is preferably adapted to be coupled to an air source as will be described in more detail below. The house inlet line 18 is preferably also coupled to an air source 20 as will be described in more detail below.

In the illustrated embodiment the air source 20 is an air compressor, however the air source 20 may comprise any means known in the art to provide high-pressure air. In the illustrated embodiment a single air source 20 is utilized, however it is completed that the house inlet line 18 and the reservoir air inlet 14 could be coupled.

Figure 2:
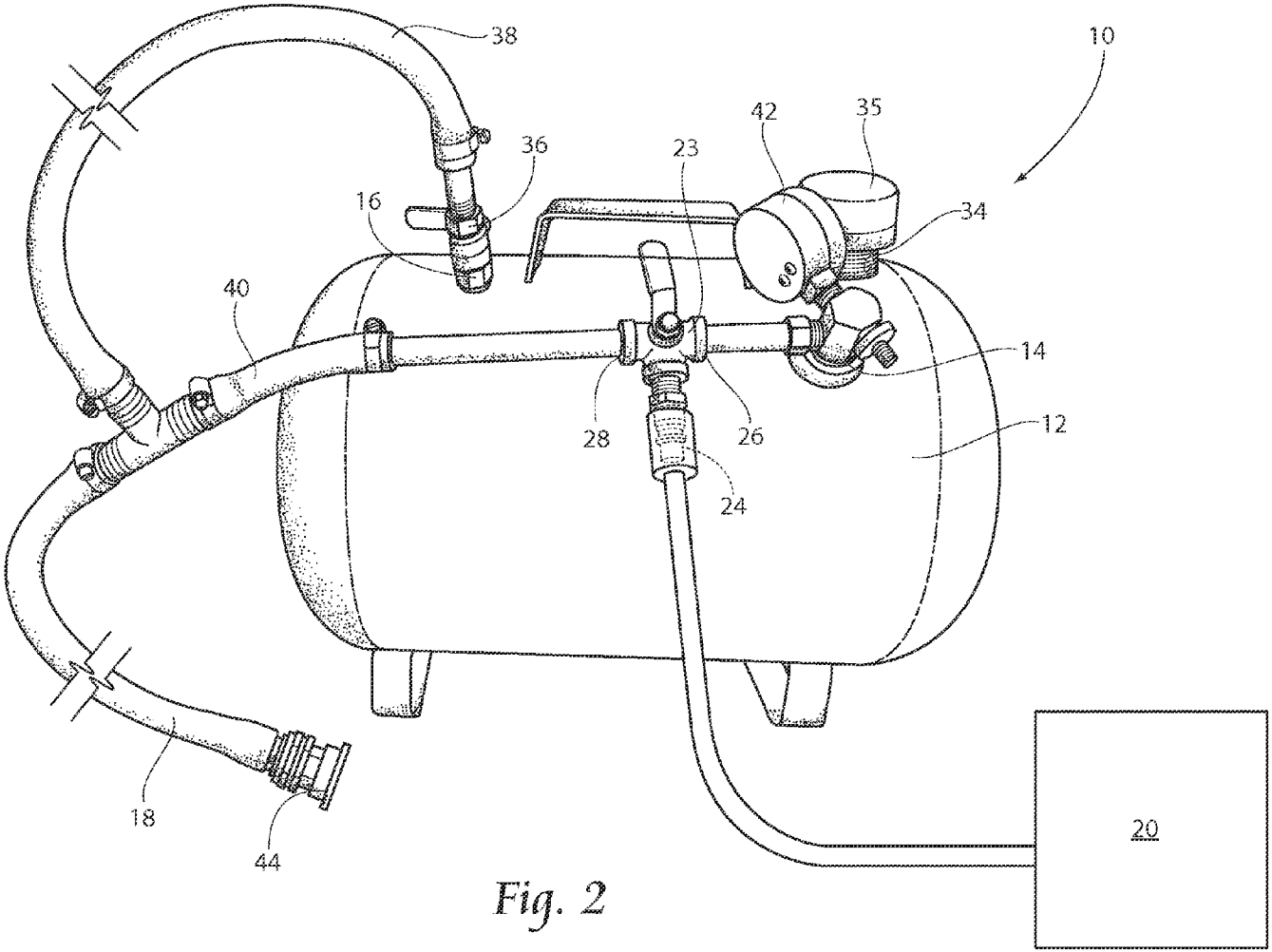
FIG. 2. is a front view of the apparatus of FIG. 1 incorporating a three-way valve.

The illustrated embodiment includes an air manifold 22 having an inlet 24 and at least two outlets 26,28. The first outlet 26 is coupled to the air inlet 14 of the reservoir 12. The second outlet 28 is coupled to the house inlet line 18. In the illustrated embodiment a valve 30,32 is located adjacent each outlet 26,28 of the air manifold 22. The valves 30,32 may take any form known in the art. In the illustrated embodiment the valves 30,32 are manual; however it is contemplated that the valves 30,32 could be coupled to an electronic controller (not shown) to automate the system. In the illustrated embodiment a valve 30,32 is located adjacent each outlet 26,28 of the air manifold 22, however it is also contemplated that the manifold 22 could take the form of a three way valve 23 as shown in FIG. 2.

The reservoir 12 of the illustrated embodiment of the apparatus 10 includes a fluid inlet 34 for providing antifreeze to the reservoir 12. The fluid inlet may also include a cap 35.

In the preferred embodiment the air inlet line 40 and the fluid inlet line 38 are coupled together to form a single house inlet line 18. The free end of the house inlet line 18 preferably includes a connector 44 to connect the line 18 to the plumbing system. The connector 44 can take any form known in the art. The inlet 24 of the air manifold 22 is preferably coupled to the air source using any means known in the art.

When the fluid valve 36 is open, and the reservoir 12 is pressurized, fluid travel through the fluid inlet line and into the house inlet line to be provided to a plumbing system. Pressurized air can be provided to the house inlet line 18 through the air inlet line 40 by opening the air-flow valve 32. In this manner, when the house inlet line 18 is coupled to the plumbing system, the fluid is pushed through the house inlet line 18 and into the plumbing system.

The reservoir 12 is pressurized by opening the reservoir air inlet valve 30 while the fluid valve 36 is closed. In this manner pressurized air, in the preferred embodiment compressed air, is provided to the reservoir 12 to pressurize the reservoir 12. The apparatus may include a pressure regulator 42 to regulate the pressure in the reservoir 12.

To provide only air to the system, for example to blow the water out of the lines of the plumbing system, the house inlet line 18 is coupled to the plumbing system. The fluid inlet valve 36 is closed and the reservoir air inlet valve 30. The air flow valve is then opened, allowing air to flow through the air inlet line 40, through the house inlet line 18 and into the plumbing system.

A method of winterizing a two bedroom RV or home using the apparatus 10 of the present invention will now be described. First, the water supply to the home is turned off. This may be done by turning off the power to the water pump or turning off the water if it is supplied by a municipality. The hot water heater is then turned off and a hose is coupled to the hot water heater to drain the water. The hose may be of any type known in the art including, for example, a garden hose.

The apparatus 10 is prepared by placing a predetermined amount of antifreeze in the reservoir 12. In the illustrated embodiment two gallons are placed in the reservoir 12. Preferably RV antifreeze is used, however any antifreeze which is safe for potable water systems may be utilized. The air source 20, preferably an air compressor, is then connected to the apparatus 10/24 fitting using any means known in the art. The apparatus 10 is then connected to the sink faucet in the second bathroom, using the 44 fitting.

The drain on the hot water heater is then opened and the hot water sink faucet in the second bathroom is opened. The air-flow valve 32 on the apparatus 10 is opened to allow air to flow from the air source 20 to the plumbing system through the sink faucet in the second bathroom. The hot water valve on the bathtub in the second bathroom is opened until air comes out. When air comes out of the hot water faucet in the bathtub, the hot water valve on the bathtub can be closed.

The hot water valve on the sink in the kitchen is opened until water stops coming out of the faucet and air is coming out of the faucet. When air comes out of the kitchen sink hot water faucet, the kitchen sink hot water valve is closed. The hot water valves on both the sink and bathtub in the first bathroom are opened until water stops coming out of each faucet and air is coming out of each faucet. The hot water valves on the sink and bathtub of the first bathroom can then be closed. The air-flow valve 32 may then be closed to stop air flow to the plumbing system.

The apparatus 10 should then be set to pressurize the fluid reservoir 12. In this illustrated embodiment this is achieved by opening the reservoir air valve 30 until the pressure in the reservoir 12 reaches the desired level. The hot water valves of each of the sink and bathtub in the second bathroom and the sink in the kitchen should be opened. A predetermined amount of antifreeze is provided to the plumbing system. In the preferred embodiment this is accomplished by opening the fluid valve 36 to put antifreeze into the plumbing system for a predetermined period of time and then closing the fluid valve 36. Note that the predetermined period of time will be dependent upon various factors including the pressure of the fluid reservoir 12. In the preferred embodiment the pressure in the fluid reservoir 12 is set to approximately 20 psi and the fluid valve 36 is opened for approximately 4-5 seconds. The air-flow valve 32 is then opened to push the antifreeze into the plumbing system. When the antifreeze is coming out of the bathtub hot water faucet the bathtub hot water valve may be closed.

Moving on to the first bathroom, the hot water valves in the sink and bathtub are opened. The air supply is then turned off. In the illustrated embodiment this is achieved by closing the air-flow valve 32. A predetermined amount of antifreeze is delivered to the plumbing system. This may be done by opening the fluid valve 36 for a predetermined amount of time to allow antifreeze to enter the plumbing system. In the preferred embodiment the valve 36 is opened for approximately 4-5 seconds at a pressure of 20 psi. It should be understood that the amount of fluid that is provided to the system can be adjusted by adjusting the pressure in the tank and the amount of time the valve is opened. The air flow to the plumbing system is then turned on to push the antifreeze into the plumbing system. In the illustrated embodiment is the achieved by opening the air-flow valve 32. The kitchen sink hot water valve should then be opened. When antifreeze is coming out of the kitchen faucet, the kitchen hot water valve is closed. Returning to the first bathroom, when antifreeze comes out the of the bathtub faucet, the bathtub hot water valve is closed. When antifreeze comes out of the sink faucet, the sink hot water valve is closed. This concludes the hot water side of the system. The hot water valve on the second bathroom sink may be closed.

With all the hot water valves turned off, the cold water side of the plumbing system may be addressed. First, all cold water valves in all rooms are opened to let water drain from them. Preferably, the apparatus 10 should still be attached to the sink faucet in the second bathroom. The air-flow valve 32 is opened to push the water out of the cold water lines. Once the water has drained from all cold water lines, all cold water valves are closed and the air-flow valve 32 is closed.

Starting in the second bathroom, the toilet is flushed and the cold water valves in the bathtub and sink are opened. A predetermined amount of antifreeze is delivered to the system. This may be done by opening the fluid valve 36 for a predetermined amount of time to allow antifreeze to enter the plumbing system. As described above, in the illustrated embodiment the valve 36 is opened for approximately 4-5 seconds at 20 psi. The air flow to the plumbing system is then turned on by opening the air-flow valve 32. When antifreeze comes out of the valve in the toilet tank, the water to the toilet tank is turned off by closing the toilet valve. When antifreeze comes out of the bathtub faucet, the bathtub cold water valve is closed. The air flow to the plumbing system may then be turned off by closing the air-flow valve 32.

The kitchen cold water valve may then be opened. In the first bathroom, the toilet is flushed and the cold water valves in the bathtub and the sink are opened. A predetermined amount of antifreeze is delivered to the system. This may be done by opening the fluid valve 36 for a predetermined amount of time to allow antifreeze to enter the plumbing system. As described above, in the illustrated embodiment the valve 36 is opened for approximately 4-5 seconds at 20 psi. The air flow to the plumbing system is then turned on by opening the air-flow valve 32. When antifreeze comes out of the kitchen sink faucet, turn off the kitchen cold water valve. Returning to the first bathroom, when antifreeze comes out of the valve in the toilet tank, the water to the toilet tank is turned off by closing the toilet valve. When antifreeze comes out of the bathtub faucet, close the bathtub cold water valve. When antifreeze comes out of the bathroom sink faucet, close the bathroom sink cold water valve.

The air-flow valve 32 can then be closed. The second bathroom cold water valve can then be closed and the apparatus may be removed from the second bathroom sink faucet.

It should be understood that in a bathroom that includes a shower, the water to the shower should be turned on to allow the water to be blown out of the hot water lines while the hot water side of the plumbing system is being addressed. For example, when the water stops flowing from the bathtub faucet, the shower valve should be adjusted to provide water to the shower head, until no more water is flowing from the shower head. The shower valve should then be returned to the original position. When antifreeze is being introduced to the hot water side of the plumbing system, after antifreeze starts flowing from the bathtub faucet, the shower valve should be adjusted to provide antifreeze to the shower head, until antifreeze begins flowing from the shower head. The shower valve should then be returned to the original position and the bathtub hot water valve can be closed.

It is contemplated that some structures do not includes a hot water system. It should be understood that a plumbing system can be winterized using the method described above, but simply eliminating the hot water side steps.

It is contemplated that some dwellings may include a washing machine. It should be understood that such plumbing system may be winterized using the previously described method. When working on the hot water side of the plumbing system, washing machine setting should be set to hot. When water is being blown out of the hot water side, the washing machine should be turned on until water stops flowing. The washing machine can then be turned off. While antifreeze is being introduced to the hot water side, the washing machine is turned on until antifreeze begins to flow. The washing machine can then be turned off. When working on the cold water side of the plumbing system, washing machine setting should be set to cold. When water is being blown out of the cold water side, the washing machine should be turned on until water stops flowing. The washing machine can then be turned off. While antifreeze is being introduced to the cold water side, the washing machine is turned on until antifreeze begins to flow. The washing machine can then be turned off. To winterize the washer machine pump, pour ½ gallon of antifreeze into washer turn washer machine to spin cycle let machine pump out then pour another ½ gallon and let it spin it also till done.

It is contemplated that some dwellings may have faucets on the outside of the dwelling. In such a dwelling, after the method described above has been completed, prior to closing the air-flow valve 32 and the second bathroom sink cold water valve, the outside faucets should be opened up until antifreeze comes out of them. Once antifreeze comes out of each outside faucet, that outside faucet may be turned off. The air-flow valve 32 and second bathroom sink cold water valve may then be closed.

It should be understood that the plumbing system of a one bathroom home or RV can be winterized using the same method described above with respect to a two bathroom home. When winterizing the plumbing system of a one bathroom home or RV, the steps relating to the first bathroom will be skipped.

It should be understood that in the illustrated method, the water lines of the plumbing system are not filled completely with antifreeze. Rather, only a small amount of antifreeze enters the water lines, ensuring that the water is out of the water lines and providing a small amount of antifreeze to the water lines.

Although the illustrated embodiment of the apparatus 10 includes manually operated valves 30,32,36, it is contemplated that the system can be automated using electronically controlled valves as are well known in the art.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A system comprising:

an air source having an air source outlet;

a fluid reservoir having an air inlet and a fluid outlet;

a house inlet line having a first end and a second end an air manifold having a manifold inlet, a first manifold outlet and a second manifold outlet, wherein the manifold inlet is in fluid communication with the air source outlet, the first manifold outlet is in selective fluid communication with the air inlet; and a second manifold having a second air inlet, a second fluid inlet, and a second outlet, wherein the second outlet is in fluid communication with the house inlet line second end, the second air inlet is in selective fluid communication with the second manifold outlet, and the second fluid inlet is in selective fluid communication with the fluid outlet, wherein when the system is in a first configuration, the air manifold directs airflow received from the air source towards the second manifold while the second fluid inlet is selectively removed from fluid communication with the fluid outlet, and wherein when the system is in a second configuration, the air manifold directs airflow received from the air source towards the air inlet while the second fluid inlet is selectively removed from fluid communication with the fluid outlet, wherein when the system is in a third configuration, the second manifold directs fluid received from the fluid outlet towards the house inlet line second end while the second air inlet is selectively removed from fluid communication with the second manifold outlet.

2. The system of claim 1 further comprising a first valve between the first manifold outlet and the fluid reservoir air inlet, a second valve between the second manifold outlet and the second air inlet, and a third valve between the fluid outlet and the second fluid inlet.

3. The system of claim 2 wherein each of the first valve, the second valve, and the third valve are manually operated valves.

4. The system of claim 2, wherein, when the system is in the first configuration, the first valve is closed, the second valve is open, and the third valve is closed.

5. The system of claim 2, wherein, when the system is in the second configuration, the first valve is open, the second valve is closed, and the third valve is closed.

6. The system of claim 2, wherein, when the system is in the third configuration, the second valve is closed and the third valve is open.

7. The system of claim 6, wherein the first valve is closed.

8. The system of claim 1, the fluid reservoir further comprising a fluid inlet.

9. The system of claim 8 wherein the fluid inlet includes a cap.

10. The system of claim 1 wherein the air manifold comprises a three-way valve.

11. The system of claim 1 further comprising a pressure regulator in fluid communication with the fluid reservoir air inlet.

12. The system of claim 1 wherein the air source comprises an air compressor.

13. The system of claim 1 wherein the first end of the house inlet line includes an adaptor sized and configured for connection to a sink faucet located in a house.

* * * * *